United States Patent [19]

Radice et al.

[11] 4,175,500

[45] Nov. 27, 1979

[54] DEVICE FOR ALIGNING CHAINS OF STITCHES IN A TWO-NEEDLE SEWING MACHINE

[75] Inventors: Angelo Radice; Giovanni Palacino, both of Milan, Italy

[73] Assignee: Rockwell-Rimoldi S.p.A., Milan, Italy

[21] Appl. No.: 893,114

[22] Filed: Apr. 3, 1978

[30] Foreign Application Priority Data

Apr. 28, 1977 [IT] Italy ..... 22903 A/77

[51] Int. Cl.[2] ..... D05B 1/10; D05B 49/00

[52] U.S. Cl. ..... 112/166; 112/242; 112/260

[58] Field of Search ..... 112/162, 163, 165, 166, 112/242, 269, 268, 260

[56] References Cited

U.S. PATENT DOCUMENTS

| | | | |
|---|---|---|---|
| 1,151,513 | 8/1915 | DeVoe | 112/242 X |
| 1,179,038 | 4/1916 | Rhodes | 112/242 |
| 1,305,051 | 5/1919 | Berger, Jr. | 112/260 |
| 1,463,325 | 7/1923 | Kiewicz | 112/242 X |
| 2,973,730 | 3/1961 | Schweda et al. | 112/162 |
| 3,123,033 | 3/1964 | Weigert | 112/162 X |
| 3,356,054 | 12/1967 | Southwell et al. | 112/162 X |

FOREIGN PATENT DOCUMENTS

| | | | |
|---|---|---|---|
| 2301619 | 9/1976 | France | 112/162 |

*Primary Examiner*—Wm. Carter Reynolds

[57] ABSTRACT

A needleplate for a two-needle sewing machine of the type for simultaneously forming a straight stitch chain and an over cast stitch chain. The plate is provided with guide surfaces which interconnect the needle holes in the plate and a device for increasing the quantity of thread normally used by the looper associated with the needle for forming the straight stitch chain. At the completion of a sewing cycle the combination of the guide surfaces and excess looper thread permit the straight stitch chains to be moved toward and in alignment with the overcast stitch chain so that they will be incorporated together in the initial stitches formed in the following workpiece.

4 Claims, 3 Drawing Figures

DEVICE FOR ALIGNING CHAINS OF STITCHES IN A TWO-NEEDLE SEWING MACHINE

BACKGROUND OF THE INVENTION

The present invention pertains to a device for cutting chains of stitches and holding them in position forwardly of the stitching instrumentalities of a two-needle sewing machine so as to incorporate said chains into the initial stitches of a new seam.

In order to incorporate the end of a completed chain of stitches into a new seam, said end must be aligned with the sewing axis, in the case of a straight-stitch seam, or within the width of the rib, in the case of overcast or zig-zag stitch seams.

This problem has been solved only for single-needle machines, whether straight-stitch machines, or overcast or zig-zag machines.

The difficulty where two-needle machines are involved lies in the fact that it is impossible to align both chains of stitches with their respective sewing axes, since there is only one cutting and gripping device for both chains.

The present invention eliminates the aforementioned problem, especially where two-needle machines for sewing "safety" seams are concerned, that is, for sewing a seam such as an overcast seam and at least one straight-stitch seam that is parallel to and spaced from the overcast seam.

SUMMARY OF THE INVENTION

The solution of the aforementioned problem, according to one of the main features of the present invention provides a device for aligning the chains of stitches at the beginning of a seam along a single axis. This axis coincides with the sewing axis of the overcast stitch and by means of the device the chains are superimposed and held in position by a single gripping member. Another feature of the present invention is that the device for aligning both chains of stitches defines an opening that interconnects the two needle holes which is disposed in front of the needles and by means of which the straight-stitch chain is adapted to move and align itself with the overcast-stitch chain.

These and other features of the invention will become more fully apparent by reference to the appended claims and as the following detailed description proceeds in reference to the figures of drawing wherein:

DESCRIPTION OF THE PREFERRED EMBODIMENT

Figure 1:
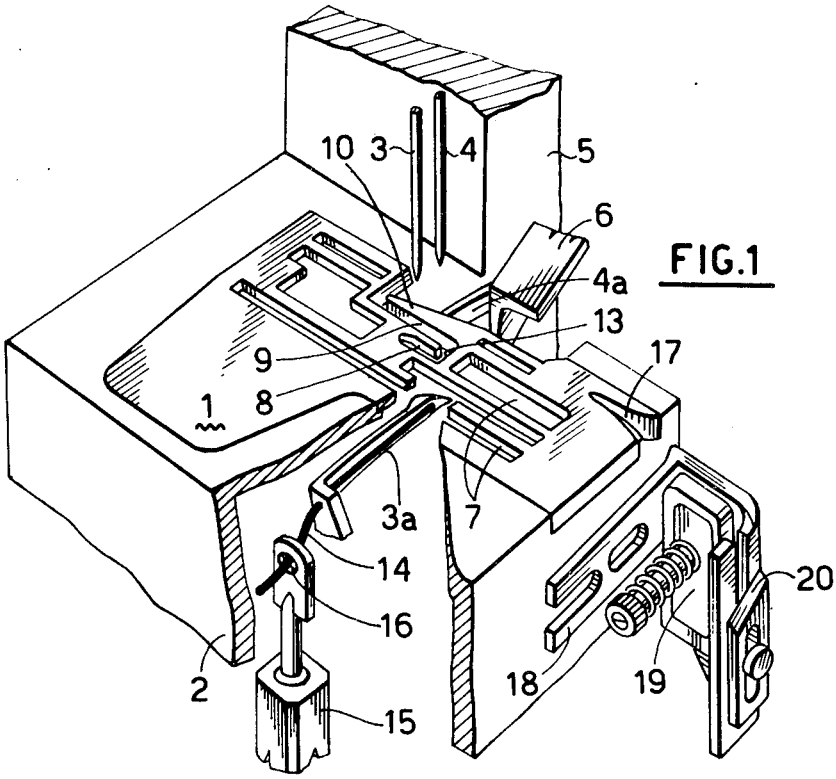
FIG. 1 is a perspective view of the sewing machine showing the device according to the invention applied thereto.

Referring now to the figures of drawing a needle plate 1 is shown assembled on a conventional sewing machine base 2. Among its many parts the machine includes two needles 3 and 4 that are actuated by well known drive means (not shown) that are mounted within an upright member 5 of said machine.

The machine also includes a trimmer knife 6 that is adapted to trim the outer edge of the material (also not shown) on which an overcast seam is to be sewn. The needle plate 1 is provided with longitudinal openings 7 through which the rows of teeth of the feed dog are caused to project during said feed dogs intended function of advancing the material being sewn.

Figure 2:
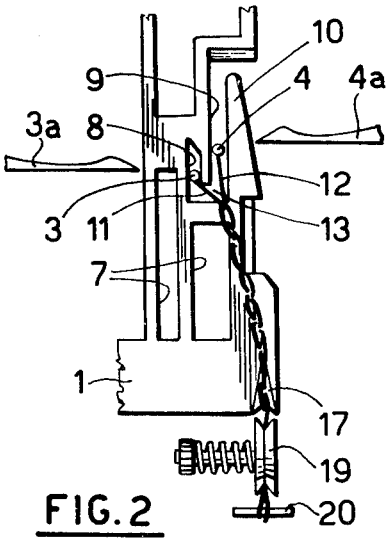
FIG. 2 is a plan view of a portion of the sewing area shown in FIG. 1.

As shown in FIGS. 1 and 2 the needle plate includes a first needle hole 8 for accommodating the needle 3 which is adapted to sew a straight-stitch seam, and a second needle hole 9 for accommodating the needle identified by numeral 4.

The needle hole 9 has a configuration that delimits a tongue 10 on which the overcast stitches are formed.

Separate loopers 3*a* and 4*a* are provided for sewing safety seams which cooperate with needles 3 and 4 respectively in order to form two series of stitches.

To form two series of stitches the operating position of needle 4 is located forwardly of needle 3 relative to the direction of movement of the material and the needle holes for each of said needles are formed in a similar manner in the needle plate.

To effect alignment of the straight-stitch chain 11 produced by needle 3 with the overcast-stitch chain 12 produced by needle 4 in conjunction with the tongue 10 and along a common axis that is in general alignment with the sewing axis of the overcast seam, the needle plate 1 is provided with a means that permits the straight-stitch seam 11 to be moved onto the overcast-stitch seam 12. This means consists essentially of opposed and spaced side surfaces that define a thread guide or opening 13 that is disposed perpendicular to the sewing axis and interconnects the two needle hole 8 and 9. The length of this opening 13 conforms to the distance between the two lines of stitches to be sewn on the material.

To provide a common overlap point for the two chains of stitches 11 and 12 at one end of the opening 13, the needle hole 9 with which said opening communicates was formed so as to have a slightly greater width than that of needle hole 8.

The movement of the chain of stitches 11 along the length of the opening 13 at the end of the sewing cycle is facilitated by a thread-adding device disposed in operative association with the looper 3*a* which cooperates with the needle 3 during the performance of its intended function.

The elements of this thread-adding device include a pneumatic cylinder 15 the actuating rod of which is provided on its outer end with a hole 16 through which a thread 14, for the above looper, is caused to extend. This cylinder 15 is connected to any suitable source of compressed air not shown, and is manually actuated by means, also not shown, such as a foot pedal or knee lever that are conventional elements and well known to those conversant in the art.

The cylinder 15 is actuated after completion of the sewing cycle so as to deflect the thread 14 from its normal path of travel causing a predetermined excess thereof to be withdrawn from its source which accumulates in that area where the chain of stitches 11 is formed. This excess of thread 14 facilitates movement of the chain of stitches 11 toward and into alignment with the chain of stitches 12.

At the end of each sewing operation, the material is manually rotated so as to pull the chains of stitches subtended between the needles and said material and effect removal of the chain of stitches 12 formed on the tongue 10. During this manual manipulation of the material the chain formed by the straight-stitch seam 11 is caused to move across the opening 13 and into alignment with the overcast stitch chain 12 and both chains are simultaneously placed in a recess 17 formed on the leading edge of the needle plate 1 which is oriented in the direction of the needle 4.

Adjacent the recess 17 elements are provided which are adapted to cut and at the same time locate the chains that must be severed from the material that has been sewn.

These elements are mounted on a support 18 that is adjustably attached to the base 2 of the machine. One of these elements is a conventional opposed disk type gripper 19 within which the chains of stitches 11 and 12 are inserted and the other element defines a blade 20 for cutting both chains. The combination of the recess 17 and the dish type gripper 19 provide a means for maintaining the aligned chains of stitches 11 and 12 along the sewing axis of the overcast stitch chain 12 and in readiness for the next sewing cycle.

Figure 3:
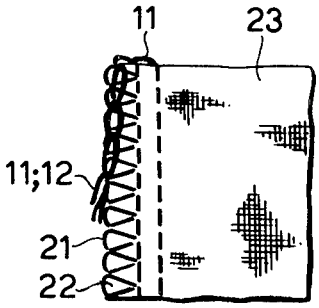
FIG. 3 is a view looking from the underside of a piece of material sewn in accordance with the present invention.

At the beginning of a new sewing cycle, the chains of stitches 11 and 12 are withdrawn from between the disks of the gripper 19 and are incorporated into the initial stitches of the overcast stitch 21 (FIG. 3) that is being formed on the edge 22 of the material 23. A portion of the chains are also cut off due to the fact that during their movement forward in the direction of the needles they are caused to contact the trim knife 6.

In the event that the safety seam is formed by several lines of straight stitches, the opening 13 must be of sufficient length to interconnect the various needle holes. In addition, the thread-adding devices must correspond in number to the number of lines of straight stitches.

Although the present invention has been described in connection with a preferred embodiment it is to be understood that modifications and variations may be restored to without departing from the spirit and scope of the invention as those skilled in the art will readily understand. Such modifications and variations are considered to be within the purview and scope of the invention and the appended claims.

We claim:

1. A needle plate with spaced needle holes for a two needle sewing machine of the type for simultaneously forming a straight stitch chain and an overcast stitch chain in a workpiece and with a separate looper and looper thread operatively associated with each needle, the improvement comprising:

(a) means interconnecting the spaced needle holes for permitting movement of the straight stitch chain into alignment with the overcast stitch chain upon completion of each sewing cycle;

(b) a thread adding means operatively associated with the looper functioning in cooperation with the needle forming the straight stitch chain for increasing the quantity of looper thread in the sewing area and facilitate alignment of the stitch chains; and (c) means for maintaining the aligned chains of stitches along the sewing axis of the overcast chain stitch for incorporating both chains in the initial stitches formed in the following workpiece.

2. The needle plate according to claim 1 where said means for permitting movement of the straight stitch chain includes opposed and spaced side surfaces defining a thread guide (13).

3. The needle plate according to claim 2 wherein said thread guide (13) is disposed forwardly of the needles and extends in a direction normal to the sewing axes.

4. The needle plate according to claim 1 wherein said thread adding means defines a pneumatic cylinder (15) having an actuating rod operatively connected to the looper thread and selectively movable for withdrawing a predetermined excess amount from its source.

* * * * *